US010231483B2

(12) United States Patent
Garcia

(10) Patent No.: US 10,231,483 B2
(45) Date of Patent: Mar. 19, 2019

(54) SYSTEM AND APPARATUS THAT FACILITATES SMOKING TOBACCO PRODUCTS

(71) Applicant: Lawrence Garcia, Fresno, CA (US)

(72) Inventor: Lawrence Garcia, Fresno, CA (US)

( * ) Notice: Subject to any disclaimer, the term of this patent is extended or adjusted under 35 U.S.C. 154(b) by 589 days.

(21) Appl. No.: 14/869,812

(22) Filed: Sep. 29, 2015

(65) Prior Publication Data

US 2016/0100628 A1 Apr. 14, 2016

Related U.S. Application Data

(60) Provisional application No. 62/063,809, filed on Oct. 14, 2014.

(51) Int. Cl.

| | |
|---|---|
| ***A24F 5/00*** | (2006.01) |
| ***A24F 1/00*** | (2006.01) |
| *A24F 47/00* | (2006.01) |

(52) U.S. Cl.

CPC ..... *A24F 5/00* (2013.01); *A24F 1/00* (2013.01); *A24F 47/008* (2013.01)

(58) Field of Classification Search

None

See application file for complete search history.

(56) References Cited

U.S. PATENT DOCUMENTS

| | | | | |
|---|---|---|---|---|
| 3,402,723 | A | 9/1968 | Hu | |
| 3,986,516 | A * | 10/1976 | Brooks | A24F 1/32 131/185 |
| 4,193,411 | A | 3/1980 | Faris et al. | |
| 5,564,442 | A | 10/1996 | MacDonald et al. | |
| 2013/0087160 | A1 | 4/2013 | Gherghe | |
| 2013/0255702 | A1 * | 10/2013 | Griffith, Jr. | A24F 47/008 131/328 |
| 2014/0174458 | A1 | 6/2014 | Katz | |
| 2014/0270730 | A1 * | 9/2014 | DePiano | A24F 47/008 392/404 |
| 2017/0027221 | A1 * | 2/2017 | Liu | H02J 7/0044 |

OTHER PUBLICATIONS

PCT/US2015/055596. Applicant: Lawrence Garcia. Int'l Search Report & Written Opinion (dated May 12, 2016).

* cited by examiner

*Primary Examiner* — Michael J Felton
*Assistant Examiner* — Katherine A Will
(74) *Attorney, Agent, or Firm* — Loza & Loza, LLP; Daniel S. Castro

(57) ABSTRACT

A smoking pipe includes a stem and a bowl in which the stem includes a smoke chamber extending from a first end of the stem to a mouthpiece on a second end. The bowl is coupled to the stem and comprises a heating surface coupled to a power source lead. The smoke chamber provides an airway through the stem from the mouthpiece to an area proximate to the heating surface. In another aspect, a method includes forming a pipe comprising a stem and a bowl, and inserting a heating surface into the bowl. In a further aspect, a smoking apparatus includes a bowl insert comprising a plurality of holes and a power source lead configured to receive power from an external power source. A heating surface is coupled to the power source lead and placed on a lower portion of the bowl insert proximate to the plurality of holes.

13 Claims, 11 Drawing Sheets

SYSTEM AND APPARATUS THAT FACILITATES SMOKING TOBACCO PRODUCTS

CROSS-REFERENCE TO RELATED APPLICATIONS

This application claims the benefit of U.S. Provisional Patent Application Ser. No. 62/063,809, filed Oct. 14, 2014, which is titled "SYSTEM AND APPARATUS THAT FACILITATES SMOKING TOBACCO PRODUCTS" and its entire contents of which are incorporated herein by reference.

TECHNICAL FIELD

The subject disclosure generally relates to the smoking of tobacco products, and more specifically to a pipe comprising an integrated heating unit.

BACKGROUND

By way of background concerning conventional smoking devices, several undesirable limitations of such devices are noted. Conventional pipes, for example, lack a heating unit for burning tobacco. As a result, pipe users are required to carry a separate incendiary device (e.g., lighter, matches, etc.), which can be easily lost and requires the use of two hands. Using two hands is particularly undesirable when smoking outdoors where incendiary devices are susceptible to the weather. In windy and/or rainy conditions, for example, smokers often require help from fellow smokers to shield their incendiary devices from the elements.

Alternatively, electronic cigarettes can be used, which do not require a separate incendiary device. An electronic cigarette, which is also known as a personal vaporizer (PV) or electronic nicotine delivery system (ENDS), is a battery-powered vaporizer which simulates tobacco smoking by producing an aerosol that resembles smoke. Electronic cigarettes generally use a heating element known as an atomizer to vaporize a liquid solution known as e-liquid. Many users, however, prefer burning shredded tobacco rather than vaporizing a synthetic liquid. Structurally, electronic cigarettes are designed to vaporize liquid internally though, which makes direct pyrolysis of a non-liquid impossible.

Accordingly, it would be desirable to provide an apparatus and methodology which overcomes these limitations. To this end, it should be noted that the above-described deficiencies are merely intended to provide an overview of some of the problems of conventional systems, and are not intended to be exhaustive. Other problems with the state of the art and corresponding benefits of some of the various non-limiting embodiments may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the sole purpose of this summary is to present some concepts related to some exemplary non-limiting embodiments in a simplified form as a prelude to the more detailed description of the various embodiments that follow.

In accordance with one or more embodiments and corresponding disclosure, various non-limiting aspects are described in connection with facilitating the smoking of tobacco products. In one such aspect, a smoking pipe is provided, which includes a stem and a bowl. Within such embodiment, the stem includes a smoke chamber extending from a first end of the stem to a mouthpiece on a second end of the stem. The bowl is coupled to the first end of the stem and comprises a heating surface coupled to a power source lead. Here, the smoke chamber is configured to provide an airway through the stem from the mouthpiece to an area proximate to the heating surface.

In another aspect, a method is provided, which includes forming a pipe comprising a stem and a bowl in which the pipe includes a smoke chamber extending from the bowl on a first end of the stem to a mouthpiece on a second end of the stem. The method further includes inserting a heating surface into the bowl. For this embodiment, the heating surface is coupled to a power source lead, and the smoke chamber is configured to provide an airway through the stem from the mouthpiece to an area proximate to the heating surface.

In a further aspect, a smoking apparatus is provided. The smoking apparatus includes a bowl insert comprising a plurality of holes and a power source lead configured to receive power from an external power source. The smoking apparatus further includes a heating surface electrically coupled to the power source lead and placed on a lower portion of the bowl insert proximate to the plurality of holes.

Other embodiments and various non-limiting examples, scenarios and implementations are described in more detail below.

BRIEF DESCRIPTION OF THE DRAWINGS

Various non-limiting embodiments are further described with reference to the accompanying drawings in which.

DETAILED DESCRIPTION

Overview

As discussed in the background, because conventional tobacco pipes lack a heating unit, such pipes require smokers to carry a separate incendiary device (e.g., lighter, matches, etc.), which can be easily lost and requires the use of two hands. The various embodiments disclosed herein are directed towards a pipe comprising an integrated heating unit to facilitate smoking tobacco products. In an exemplary embodiment, a pipe is configured to include a bowl insert, wherein the bottom of the insert includes a heating surface coupled to an internal power source. The pipe is further configured to include a button which operates as a switch, wherein a circuit between the heating surface and power source is closed upon pressing the button. Moreover, within such embodiment, the button is configured to facilitate transitioning the heating surface between a "heated" and "unheated" state. Thus, unlike conventional pipes which require the use of two hands (i.e., one hand to hold the pipe and another hand to light the pipe), the button feature disclosed herein desirably enables smokers to light a pipe with the same hand used to hold the pipe. Such a feature is particularly desirable in windy/rainy conditions where the user may want to use their free hand to shield the bowl of the pipe.

Exemplary Pipe Embodiments

Figure 1:
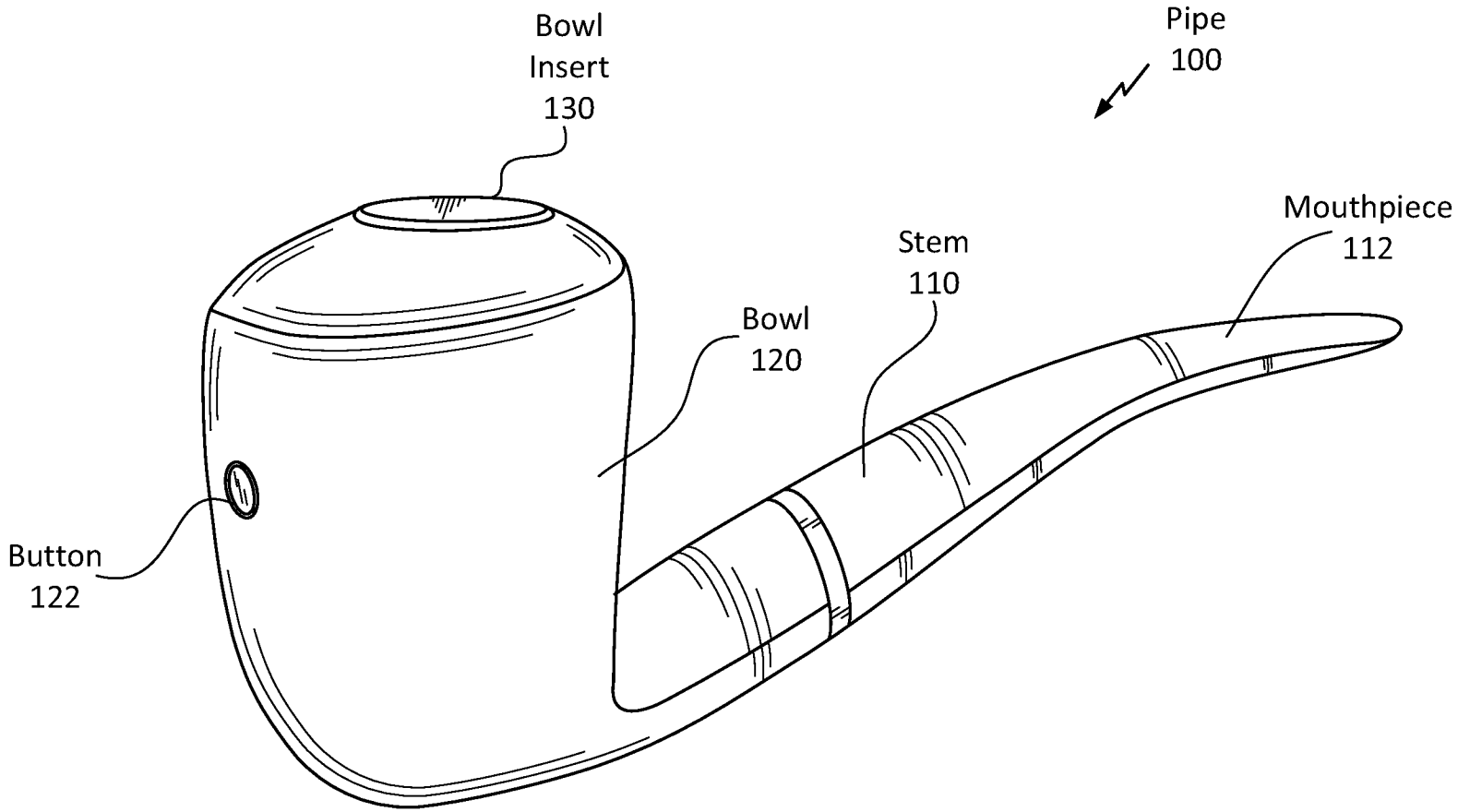
FIG. 1 is a perspective illustration of an exemplary pipe apparatus in accordance with an aspect of the subject specification.
Figure 2:
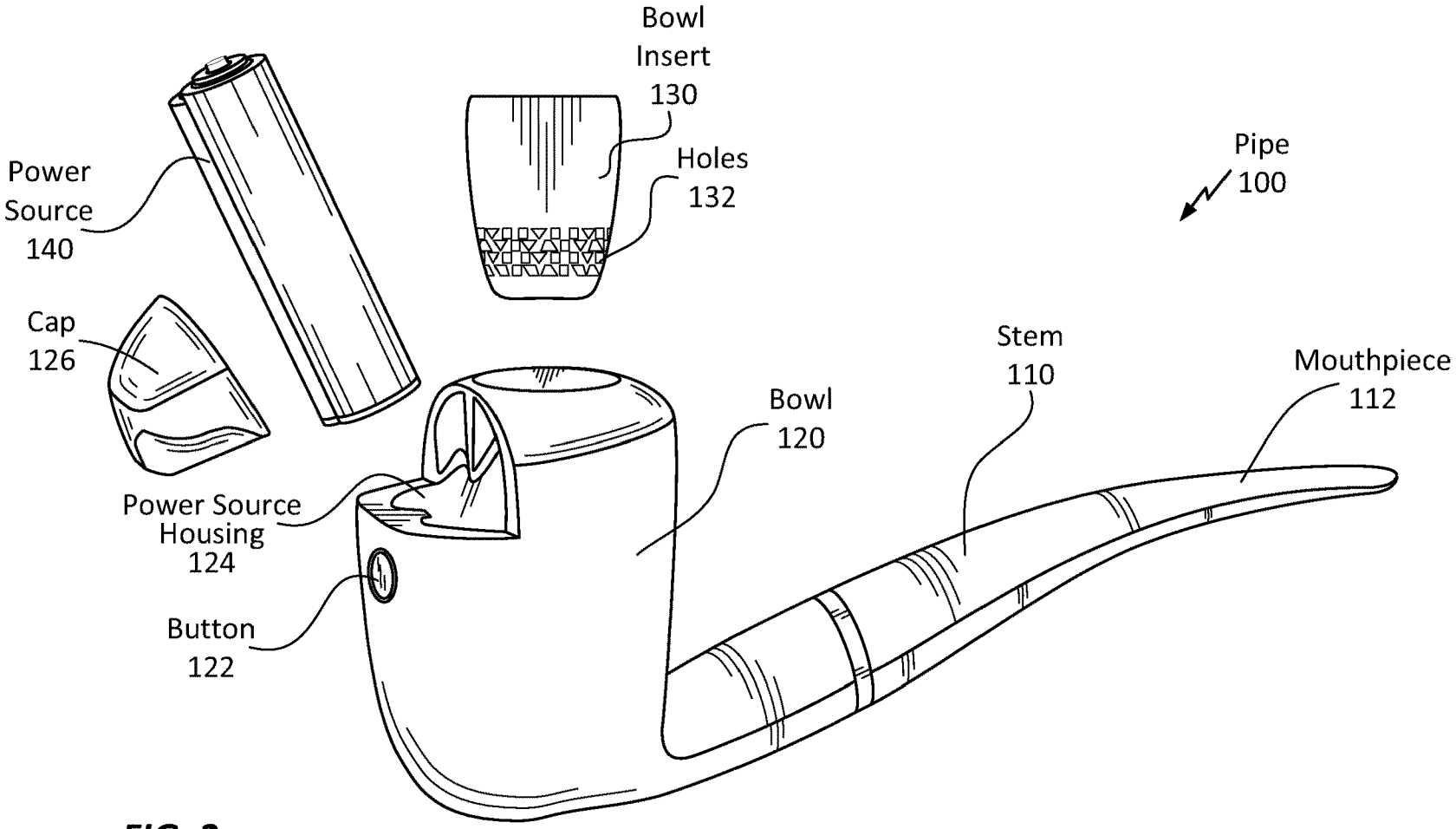
FIG. 2 is a partially disassembled view of the pipe apparatus shown in FIG. 1 which illustrates various exemplary components.

Referring first to FIGS. 1-2, perspective illustrations of an exemplary pipe apparatus and corresponding components are provided in accordance with an aspect of the disclosure. As illustrated, pipe 100 comprises a stem portion 110, a bowl portion 120, a bowl insert portion 130, and a power source 140. Within such embodiment, bowl 120 further comprises button 122, power source housing 124, and cap 126, as shown, wherein power source housing 124 and cap 126 are configured to house power source 140 within pipe 100 during operation. In a particular aspect of the disclosure, to facilitate integrating a heating unit into pipe 100, power source 140 is coupled to bowl insert 130 via internal circuitry so as to heat a bottom portion of bowl insert 130 upon pressing button 122. For instance, as indicated above, button 122 may be configured to operate as a switch, wherein such heat is generated by completing a circuit between a bottom portion of bowl insert 130 and power source 140 upon pressing button 122. During an exemplary operation of pipe 100, it is thus contemplated that tobacco shreds making contact with a bottom portion of bowl insert 130 will begin to burn upon pressing button 122. Then, by contemporaneously applying a drawing force at mouthpiece 112, the generated smoke will travel through stem 110 via holes 132 of bowl insert 130. Once a desired amount of smoke has been drawn, a user may then stop the heating process by releasing button 122 so as to break the circuit between bowl insert 130 and power source 140.

Figure 3A:
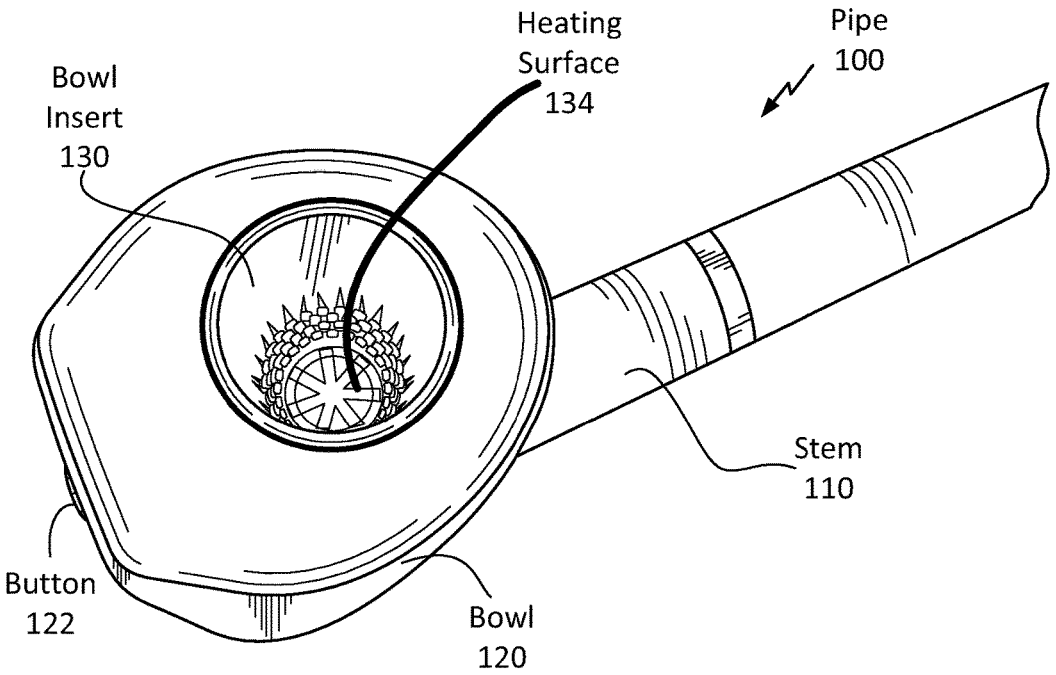
FIG. 3A is a top view of an exemplary pipe apparatus prior to activation in accordance with an aspect of the subject specification.
Figure 3B:
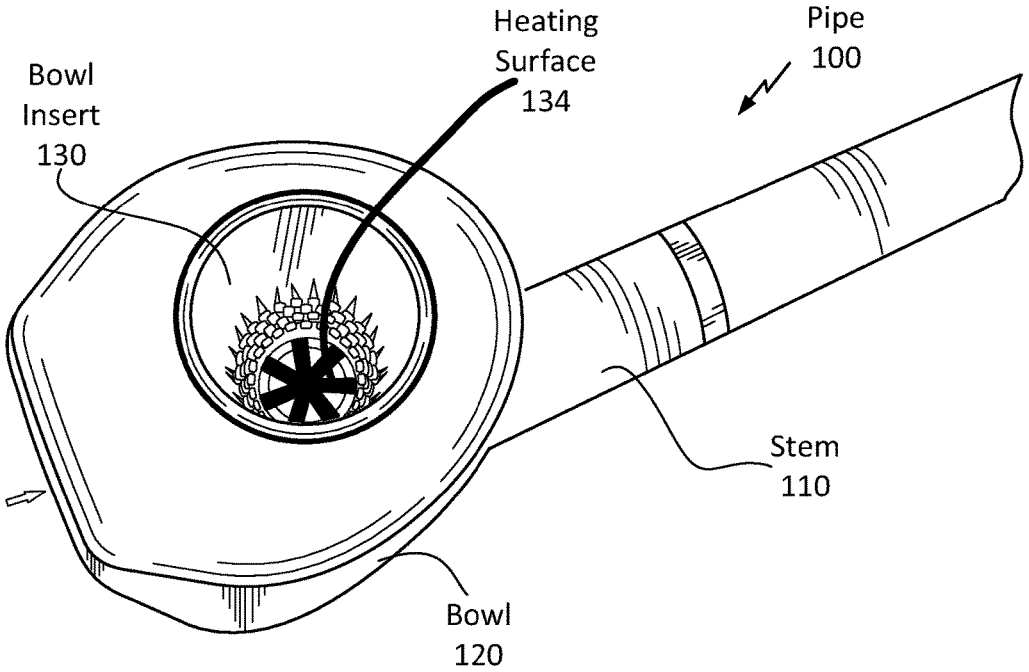
FIG. 3B is a top view of an exemplary pipe apparatus while activated in accordance with an aspect of the subject specification.

Referring, next to FIGS. 3A-3B, an exemplary transition of pipe 100 from an "unheated" state to a "heated" state is provided. In particular, FIG. 3A illustrates an exemplary top view of pipe 100 prior to activation, whereas FIG. 3B illustrates an exemplary top view of pipe 100 while activated. For this embodiment, the bottom portion of bowl insert 130 comprises a star-shaped heating surface 134, as shown. In FIG. 3A, because button 122 is at rest, heating surface 134 is not activated. In FIG. 3B, however, because button 122 is now pressed, heating surface 134 begins to generate heat, which is represented here by the darkening of heating surface 134.

Figure 4:
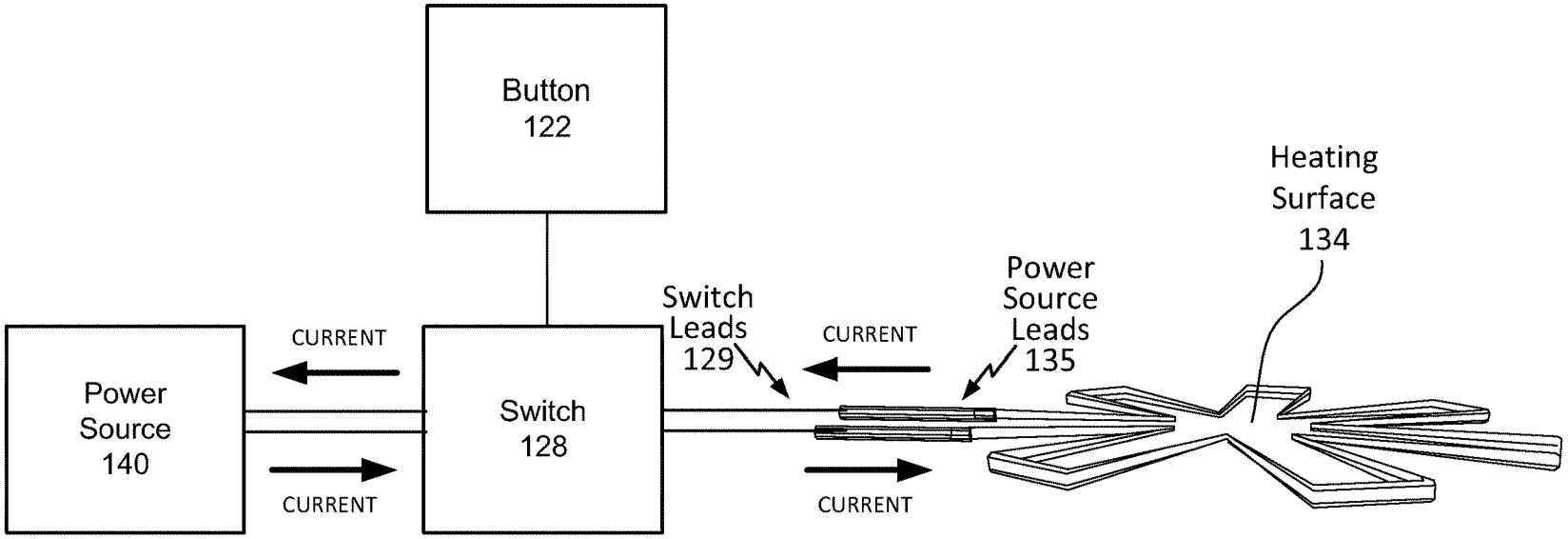
FIG. 4 is a schematic diagram of an exemplary heat-producing circuitry in accordance with an aspect of the subject specification.

An exemplary heat-producing circuitry for pipe 100 is now discussed with reference to FIG. 4. As illustrated, such circuitry may comprise connecting power source 140 to heating surface 134 via switch 128, wherein switch 128 is controlled by button 122. Moreover, for this particular embodiment, it is contemplated that a circuit between power source 140 and heating surface 134 is closed via switch 128 upon pressing button 122. By closing this circuit, current circulates between power source 140 and heating surface 134, wherein current into and out of heating surface 134 travels via switch leads 129 and power source leads 135, as shown.

It is contemplated that the aforementioned circulation of current can be utilized to generate heat on heating surface 134, as desired. Since particular heat-related specifications may be desired, however, it is noted that material used for heating surface 134 may be selected according to those desired specifications. For instance, because it may be desirable that the selected material heat and cool quickly, substances exhibiting such thermal properties may be selected (e.g., aluminum, tungsten, and/or any of various other elements/alloys known in the art). To this end, in a particular embodiment, it is contemplated that heating surface 134 may be configured to operate similar to filaments of a cautery pen device commonly used for surgical procedures. Indeed, filaments of a cautery pen operate as heating elements, wherein it is desirable for such filaments to heat and cool quickly, as desired. Here, because it would be similarly desirable to heat and cool heating surface 134 quickly, it is contemplated that heating surface 134 may be designed utilizing similar materials and according to similar electrical configurations (e.g., using alkaline batteries for power source 140). Although cautery pens are well known, several cautery pen designs are hereby incorporated by reference to U.S. Pat. No. 4,563,570 and U.S. Pat. No. 5,688,265 in their entirety. Furthermore, although heating surface 134 may be configured to include aspects similar to filaments of a cautery pen device, one of ordinary skill will appreciate that heating surface 134 may be implemented in any of various ways known in the art including, but not limited to, metallic heating elements (e.g., resistance wire, etched foil, etc.), ceramic heating elements (e.g., molybdenum disilicide, positive temperature coefficient ceramic elements, etc.), and/or composite heating elements (e.g., tubular heating elements, screen-printed elements, etc.).

Figure 5A:
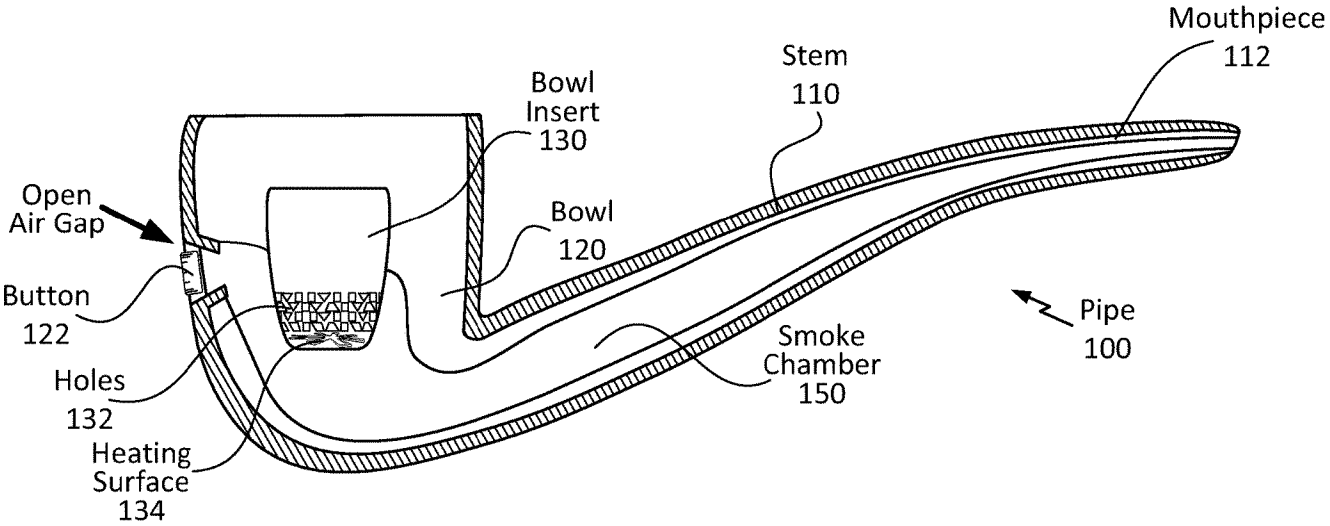
FIG. 5A is a cross sectional view of an exemplary pipe apparatus prior to activation in accordance with an aspect of the subject specification.
Figure 5B:
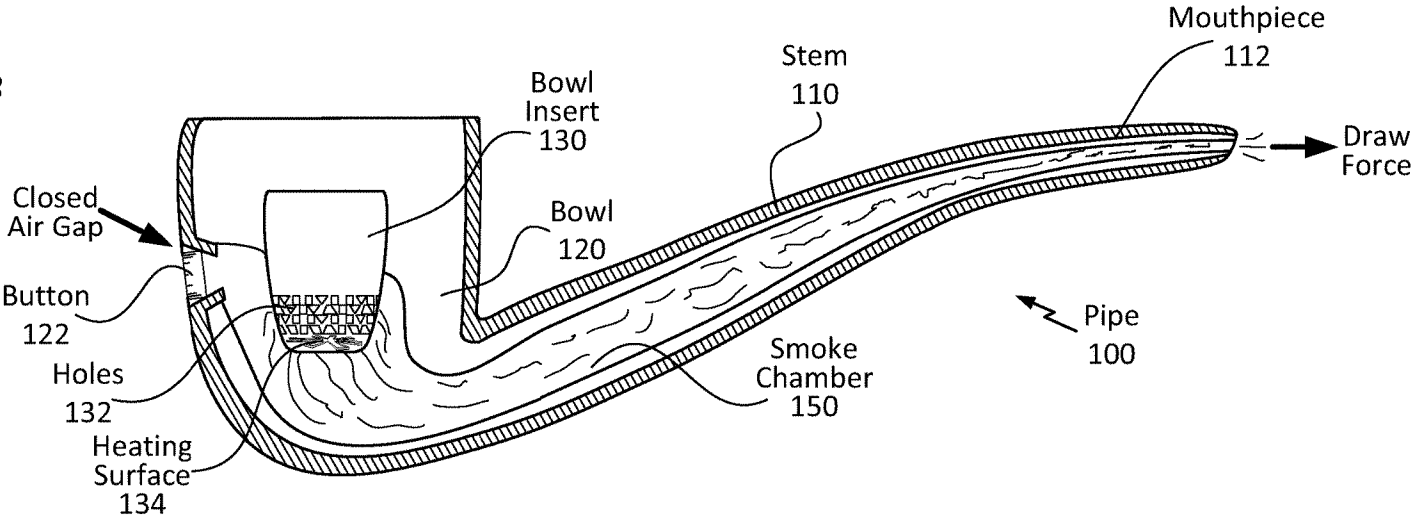
FIG. 5B is a cross sectional view of an exemplary pipe apparatus while activated in accordance with an aspect of the subject specification.

Referring next to FIGS. 5A-5B, cross sectional views of an exemplary pipe apparatus prior to and during activation are respectively provided in accordance with a disclosed embodiment. For purposes of illustrative clarity, various components were omitted from FIGS. 5A-5B including, for example, power source 140 and the aforementioned circuitry connecting power source 140, button 122, and heating surface 134. Although not shown, it should nevertheless be appreciated that inclusion of such components is indeed contemplated for this particular example as well as various other embodiments disclosed herein.

For this embodiment, pipe 100 comprises smoke chamber 150, which extends from a bottom portion of bowl insert 130 through stem 110, wherein smoke chamber 150 includes an area encircling holes 132, as shown. To facilitate proper air flow during use, it is contemplated that smoke chamber 150 may further encompass an area just above button 122. Indeed, within such embodiment, an air gap surrounding a perimeter of button 122 and proximate to bowl 120 may be closed upon pressing button 122, as shown. During use, tobacco placed within bowl insert 130 will thus begin to burn contemporaneously with the closing of this air gap. Moreover, it is contemplated that smoke will fill smoke chamber 150 via holes 122 upon activation of heating surface 134 as the user simultaneously presses button 122 and applies a drawing force via mouthpiece 112. Once a desired amount of smoke has been drawn into smoke chamber 150, the user may then release button 122, which simultaneously deactivates heating surface 134 and again creates an air gap around button 122. By reintroducing this air gap, smoke within smoke chamber 150 can then be cleared by the user with a smaller drawing force.

Figure 6:
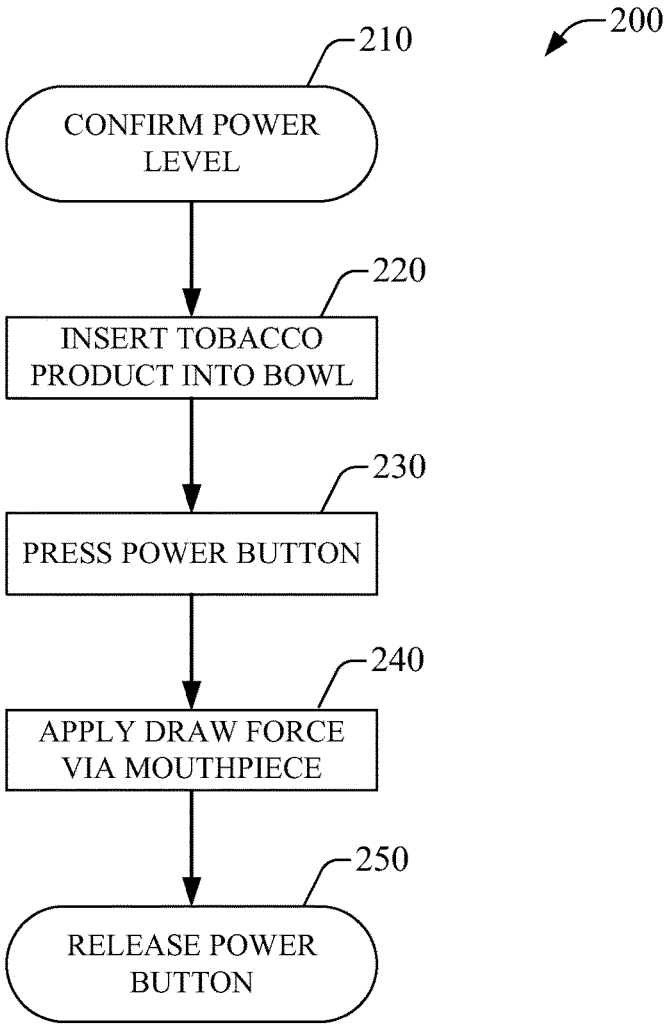
FIG. 6 is a flowchart illustrating exemplary steps for utilizing a pipe apparatus according to an embodiment.

Referring next to FIG. 6, a flowchart is provided illustrating exemplary steps for utilizing a pipe apparatus according to an embodiment. As illustrated, process 200 begins at act 210 with the user confirming that the pipe 100 has adequate power. In one embodiment, such confirmation may comprise simply pressing button 122 and seeing whether heating surface 134 lights up. In other embodiments, however, a power indicator light may be incorporated into pipe 100, wherein the power indicator light may be configured to indicate whether power source 140 has adequate power.

Once the power level has been confirmed, process 200 proceeds to act 220 where a tobacco product is inserted into bowl insert 130. Button 122 is then pressed at act 230, which provides power to heating surface 134 and closes the air gap surrounding button 122. Here, as heating surface 134 begins to heat, tobacco placed within bowl insert 130 begins to burn contemporaneously with the closing of the air gap. As button 122 is pressed, the user then applies a drawing force from mouthpiece 112 at act 240, which begins to fill smoke chamber 150 with smoke via holes 122. Once a desired amount of smoke has been drawn into smoke chamber 150, the user may then release button 122 at act 250, which simultaneously deactivates heating surface 134 and again creates an air gap around button 122. As previously stated, by reintroducing this air gap, smoke within smoke chamber 150 can then be cleared by the user with a smaller drawing force.

Figure 7A:
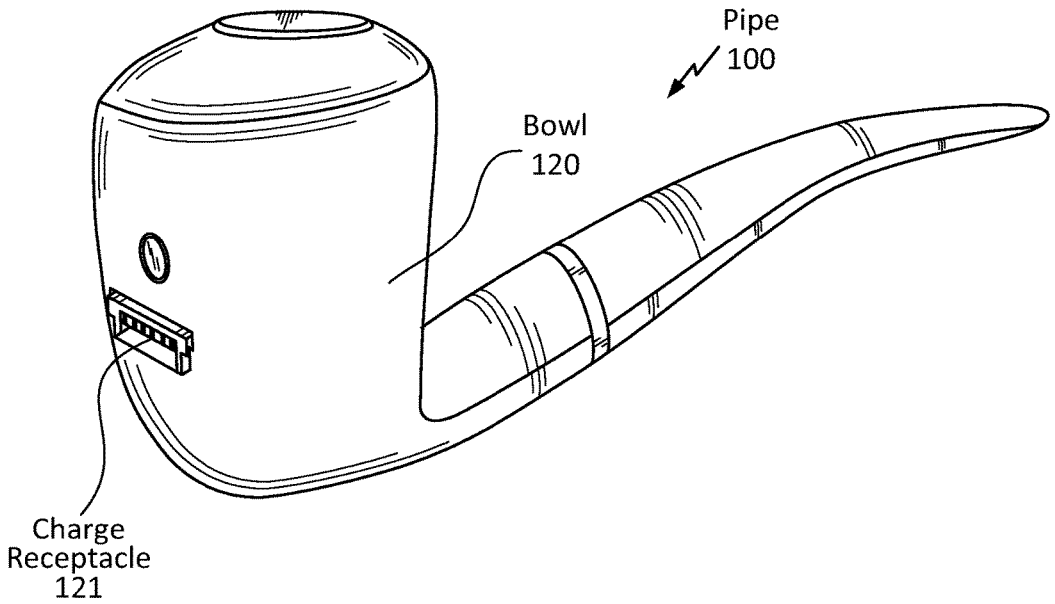
FIG. 7A illustrates an exemplary rechargeable pipe apparatus in accordance with a first embodiment.
Figure 7B:
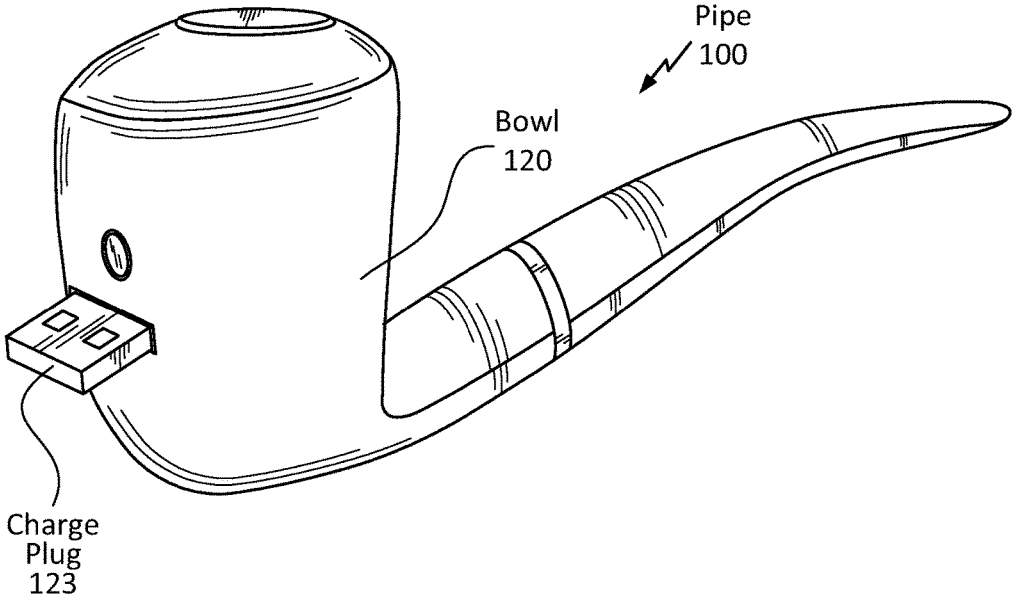
FIG. 7B illustrates an exemplary rechargeable pipe apparatus in accordance with a second embodiment.

In another aspect of the disclosure, it is contemplated that power source 140 may be rechargeable. For instance, as illustrated in FIGS. 7A-7B, exemplary rechargeable configurations are illustrated in accordance with two respective embodiments. In FIG. 7A, for example, pipe 100 includes charge receptacle 121 at a front portion of bowl 120, as shown. Within such embodiment, charge receptacle 121 may be configured to receive a universal serial bus (USB) cable, wherein power source 140 is recharged via a USB charging port when the USB cable is connected to an external power source (e.g., a wall outlet, a car's electrical system, etc.).

Similarly, rather than configuring pipe 100 to include a receptacle, pipe 100 may be configured to include charge plug 123, as illustrated in FIG. 7B. In a particular embodiment, charge plug 123 is a USB plug, wherein power source 140 is recharged by inserting charge plug 123 into a USB receptacle coupled to an external power source (e.g., a wall outlet, a car's electrical system, etc.).

Here, although USB-based configurations for recharging power source 140 have been discussed, it should be appreciated that any of various non-USB configurations may be utilized. Power adapters configured to recharge mobile phones, for instance, wherein any of various non-USB power adapter configurations known in the art are contemplated (e.g., solar chargers, motion chargers, etc.).

Figure 8:
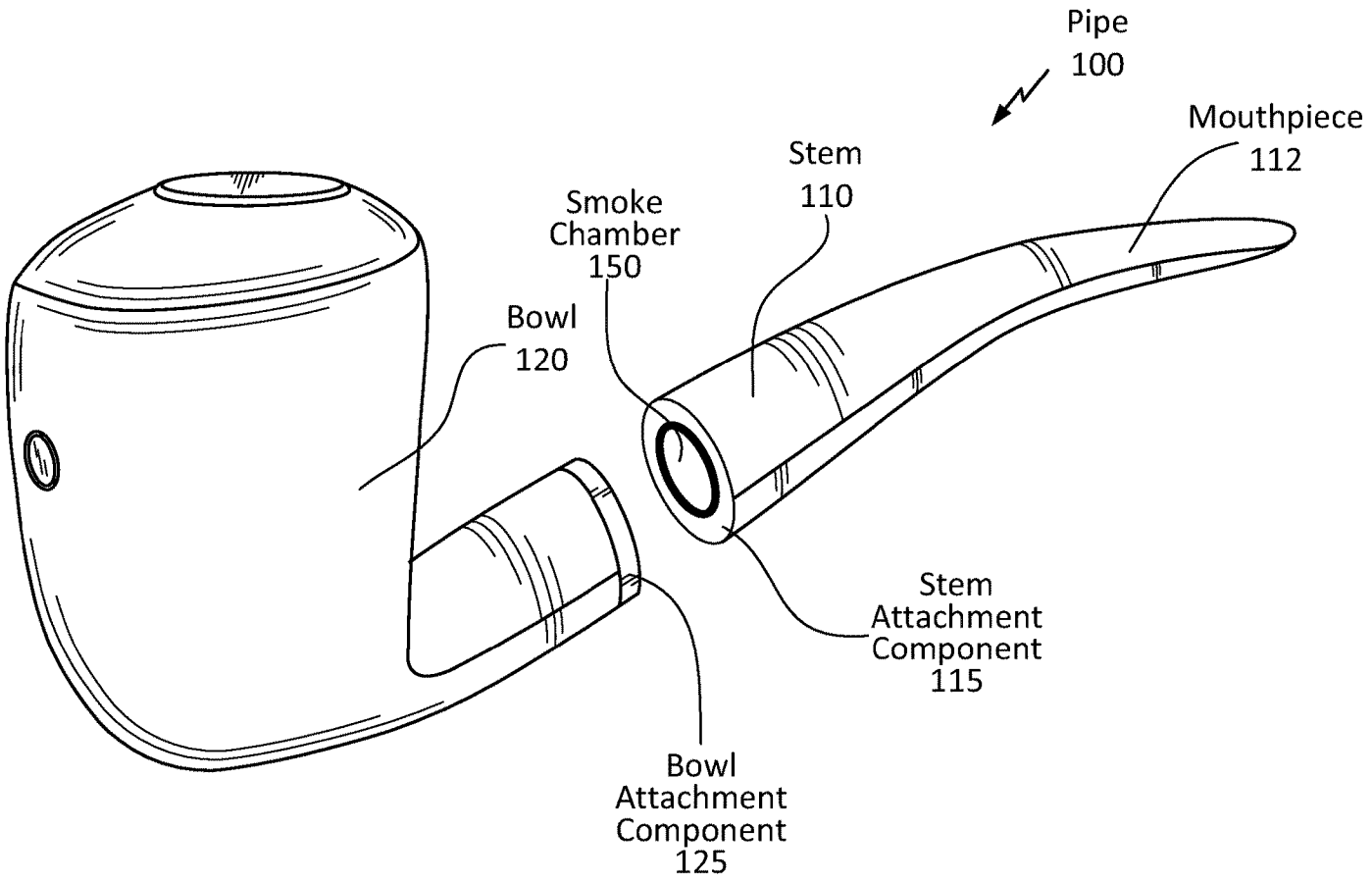
FIG. 8 illustrates an exemplary detachable stem in accordance with an aspect of the subject specification.

In yet another aspect of the disclosure, because pipe users may want to share their pipe with other users, implementing a replaceable stem design may be desired in which the same bowl can be used with multiple stems. In FIG. 8, for instance, an exemplary detachable stem configuration is provided in accordance with an aspect of the subject specification. For this particular embodiment, stem 110 and bowl 120 respectively comprise stem attachment component 115 and bowl attachment component 125, as shown. Moreover, it is contemplated that stem attachment component 115 and bowl attachment component 125 are each configured to attach and detach from each other, wherein any of various attachment mechanisms may implemented. For instance, a magnetic mechanism may be utilized, wherein stem attachment component 115 and bowl attachment component 125 have opposite magnetic polarizations. Here, to avoid magnetic repulsion when interchanging stems, it may be desirable to uniformly polarize all stem attachment components according to a first polarization and all bowl attachment components according to a second polarization opposite to the first polarization.

Various other stem attachment mechanisms are also contemplated. For instance, stem attachment component 115 and bowl attachment component 125 may be configured to mate with each other. A screw thread configuration may be implemented, for example, wherein stem attachment component 115 is a hollow male thread, whereas bowl attachment component 125 is a female thread. In another example, rather than threads, stem attachment component 115 and bowl attachment component 125 may be configured to attach and detach via a snap-fit mechanism.

Exemplary Pipe Generation Embodiments

Figure 9:
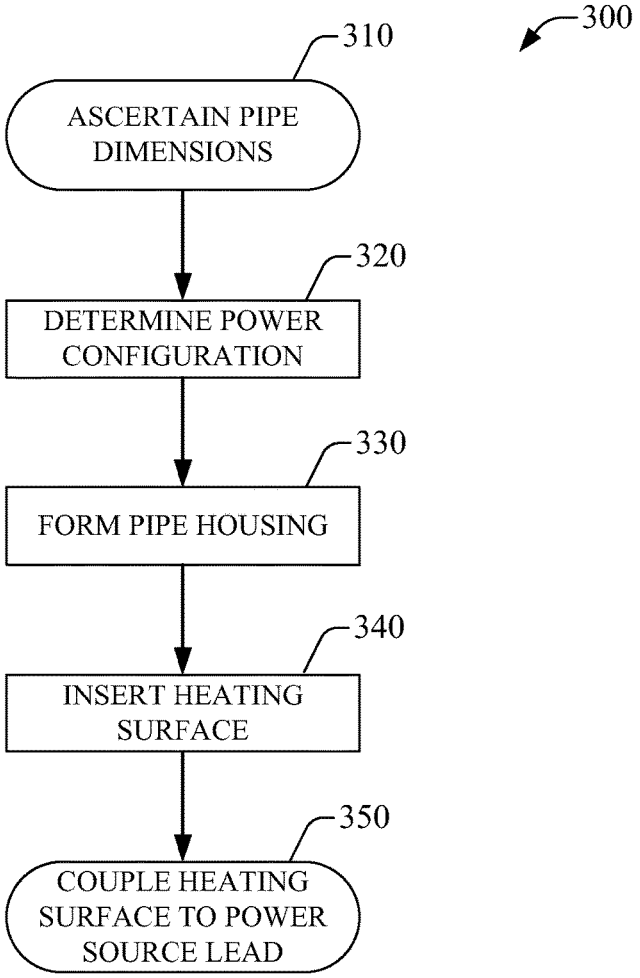
FIG. 9 is a flowchart illustrating exemplary steps for building a pipe apparatus according to an embodiment.

Referring next to FIG. 9, a flowchart is provided illustrating exemplary steps for building a pipe apparatus according to an embodiment. As illustrated, process 300 begins at act 310 with dimensions ascertained for the pipe. To this end, it should be appreciated that parameters for any of a plurality of dimensions may be ascertained (e.g., length of stem 110, depth of bowl 120, etc.). Once the dimensions of the pipe have been ascertained, process 300 proceeds to act 320 where the desired power configuration is determined In one embodiment, if a replaceable battery design is desired, such configuration may include allocating space for power source housing 124, for instance. Alternatively, if a rechargeable design is desired, such configuration may include determining whether to include charge receptacle 121 or charge plug 123.

Figure 10A:
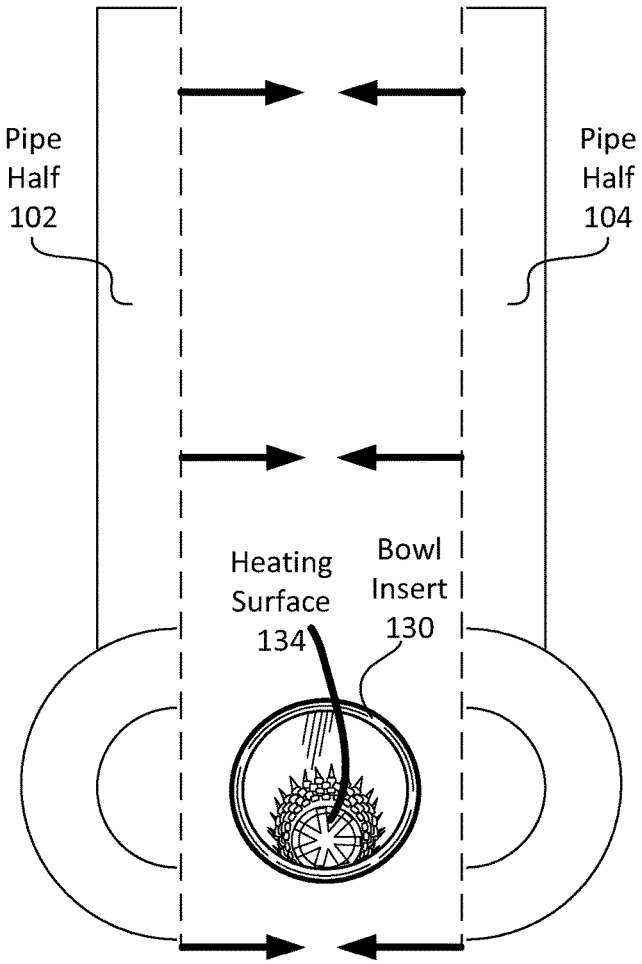
FIG. 10A is a first schematic illustrating an exemplary creation of a pipe apparatus from two cross sectional halves according to an embodiment.
Figure 10B:
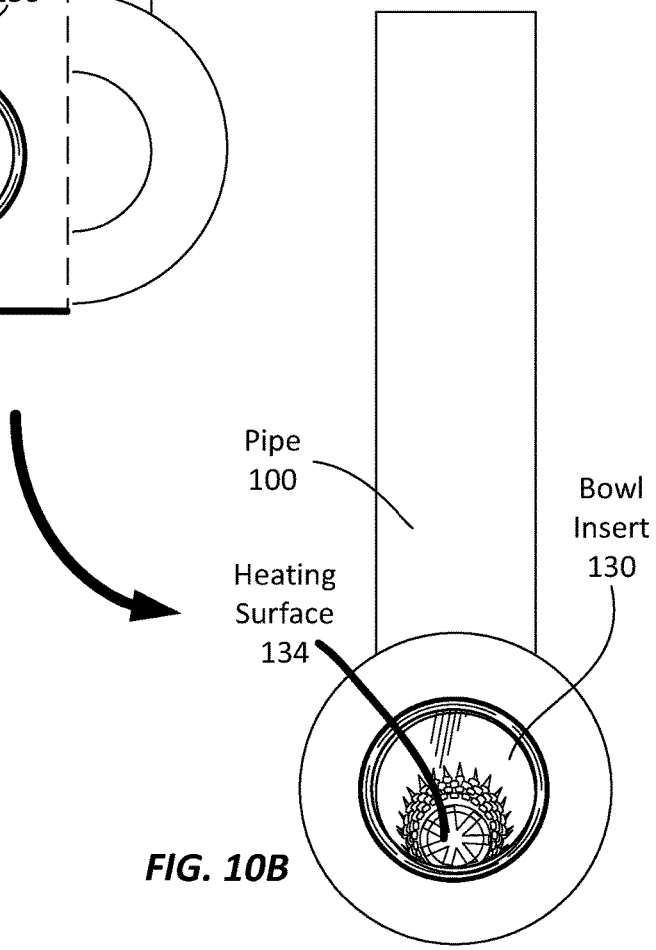
FIG. 10B is a second schematic illustrating an exemplary creation of a pipe apparatus from two cross sectional halves according to an embodiment.

At act 330, pipe 100 is then formed based on the dimensions ascertained at act 310 and the power configuration determined at act 320. For instance, as illustrated in FIGS. 10A-10B, pipe 100 may be formed by first creating cross sectional halves, 102 and 104, of pipe 100. In a particular embodiment, an injection molding method is utilized to create a mold for each of pipe half 102 and pipe half 104 having the desired dimensions and power configuration. Once formed, pipe half 102 can be attached to pipe half 104 to form pipe 100 which includes a smoke chamber 150 extending from the bowl 120 on a first end of the stem 110 to a mouthpiece 112 on a second end of the stem 110. If desired, the forming at act 330 may further comprise forming a first portion of the stem 110 to be separable from a second portion of the stem 110 to form the detachable stem embodiment illustrated in FIG. 8.

Once pipe 100 has been formed, heating surface 134 is then inserted into bowl 120, at act 340. As illustrated in FIGS. 10A-10B, heating surface 134 may be coupled to bowl insert 130, wherein act 340 comprises inserting bowl insert 130 together with heating surface 134 into bowl 120. Process 300 then concludes at act 350 with heating surface 134 coupled to a power source lead. Here, such coupling may further comprise coupling button 122 to the power source lead, wherein button 122 is configured to facilitate transitioning heating surface 134 between a heated state and an unheated state. Within such embodiment, the forming at act 330 may thus further comprise extending the smoke chamber 150 to an air gap surrounding a perimeter of button 122, wherein button 122 is configured to seal the air gap while in a pressed state. Also, if a rechargeable design is desired, the coupling at act 350 may further comprise coupling a rechargeable power source to the power source lead, wherein the rechargeable power source may be configured to charge via a USB connection, for instance.

Exemplary Bowl Insert Embodiments

Figure 11A:
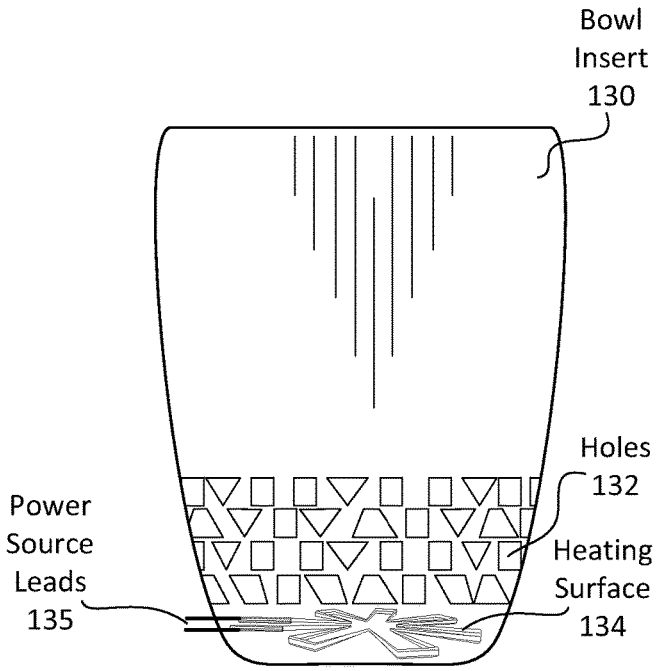
FIG. 11A is a schematic illustrating a side view of an exemplary bowl insert according to an embodiment.
Figure 11B:
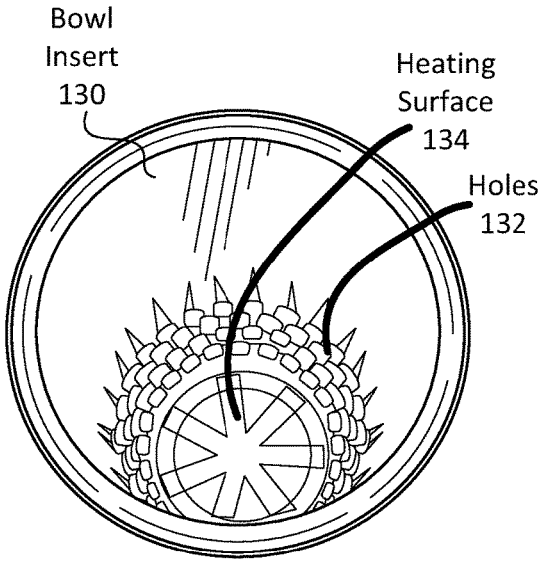
FIG. 11B is a schematic illustrating a top view of an exemplary bowl insert prior to activation according to an embodiment.
Figure 11C:
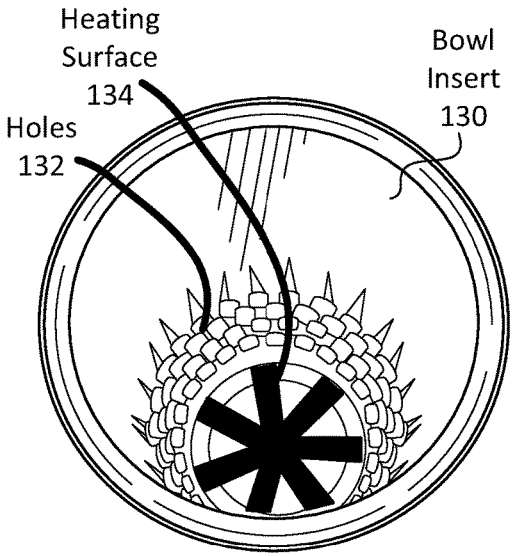
FIG. 11C is a schematic illustrating an exemplary bowl insert while activated according to an embodiment.

Referring next to FIGS. 11A-11C, various schematics are provided illustrating an exemplary bowl insert according to an embodiment. In FIG. 11A, for instance, a side view of an exemplary bowl insert is provided, whereas FIG. 11B is a top view of the bowl insert prior to activation, and FIG. 11C is a top view of the bowl insert while activated. As illustrated, bowl insert 130 comprises a plurality of holes 132 and a power source lead 135, wherein the power source lead 135 is configured to receive power from an external power source (e.g., power source 140). Heating surface 134 is then placed on a lower portion of bowl insert 130 proximate to the plurality of holes 132, wherein heating surface 134 is electrically coupled to power source lead 135. As previously stated, since particular heat-related specifications may be desired, material used for heating surface 134 may be selected according to those desired specifications. For instance, because it may be desirable that the selected material heat and cool quickly, substances exhibiting such thermal properties may be selected (e.g., aluminum, tungsten, and/or any of various other elements/alloys known in the art). Particular shapes are also contemplated for heating surface 134, such as the star-shaped configuration shown in FIGS. 11A-11C. Other shapes may include concentric circles, a solid circle, etc.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components coupled to other components rather than included within parent components (hierarchical). Additionally, it is noted that one or more components may be combined into a single component providing aggregate functionality or divided into several separate sub-components, and any one or more middle layers may be provided to couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter can be appreciated with reference to the various figures. While for purposes of simplicity of explanation, the methodologies are described as a series of steps, it is to be understood and appreciated that the disclosed subject matter is not limited by the order of the steps, as some steps may occur in different orders and/or concurrently with other steps from what is described herein. Moreover, not all disclosed steps may be required to implement the methodologies described hereinafter.

While the various embodiments have been described in connection with the exemplary embodiments of the various figures, it is to be understood that other similar embodiments may be used or modifications and additions may be made to the described embodiment for performing the same function without deviating there from. Therefore, the present invention should not be limited to any single embodiment.

What is claimed is:

1. A smoking pipe, comprising:

a stem, wherein the stem includes a smoke chamber extending from a first end of the stem to a mouthpiece on a second end of the stem; and a bowl coupled to the first end of the stem, wherein the bowl comprises a heating surface coupled to a power source lead, and wherein the smoke chamber is configured to provide an airway through the stem from the mouthpiece to an area proximate to the heating surface, the bowl further comprising a button coupled to the power source lead and configured to facilitate transitioning the heating surface between a heated state and an unheated state, wherein the smoke chamber extends to an air gap surrounding a perimeter of the button, and wherein the button is configured to seal the air gap while in a pressed state.

2. The smoking pipe of claim 1, wherein the stem comprises a first portion separable from a second portion.

3. The smoking pipe of claim 2, wherein an end of the first portion comprises a magnet of a first polarity, and wherein an end of the second portion comprises a magnet of a second polarity opposite of the first polarity.

4. The smoking pipe of claim 1, further comprising a rechargeable power source coupled to the power source lead.

5. The smoking pipe of claim 4, wherein the rechargeable power source comprises a charge receptacle, and wherein the rechargeable power source is configured to recharge via the charge receptacle.

6. The smoking pipe of claim 4, wherein the rechargeable power source comprises a charge plug, and wherein the rechargeable power source is configured to recharge via the charge plug.

7. The smoking pipe of claim 1, wherein the power source lead is configured to receive power from at least one replaceable battery.

8. A method, comprising:

forming a pipe comprising a stem and a bowl, wherein the pipe includes a smoke chamber extending from the bowl on a first end of the stem to a mouthpiece on a second end of the stem;

inserting a heating surface into the bowl, wherein the heating surface is coupled to a power source lead, and wherein the smoke chamber is configured to provide an airway through the stem from the mouthpiece to an area proximate to the heating surface; and coupling a button to the power source lead, wherein the button is configured to facilitate transitioning the heating surface between a heated state and an unheated state, wherein the forming comprises extending the smoke chamber to an air gap surrounding a perimeter of the button, and wherein the button is configured to seal the air gap while in a pressed state.

9. The method of claim 8, wherein the heating surface is coupled to a bowl insert, and wherein the inserting comprises inserting the bowl insert together with the heating surface into the bowl.

10. The method of claim 8, wherein the forming comprises attaching a first cross section of the pipe to a second cross section of the pipe.

11. The method of claim 8, wherein the forming comprises forming a first portion of the stem to be separable from a second portion of the stem.

12. The method of claim 8, further comprising coupling a rechargeable power source to the power source lead.

13. The method of claim 12, wherein the rechargeable power source is configured to charge via a universal serial bus (USB) connection.

* * * * *